United States Patent [19]

Russell

[11] Patent Number: 4,479,318

[45] Date of Patent: Oct. 30, 1984

[54] PAPERBOARD PICTURE FRAME OR THE LIKE SUPPORT AND DISPLAY

[75] Inventor: Dennis E. Russell, Jonesboro, Ark.

[73] Assignee: Alton Packaging Corporation, Alton, Ill.

[21] Appl. No.: 447,540

[22] Filed: Dec. 7, 1982

[51] Int. Cl.[3] ..... A47G 1/06; G09F 1/12

[52] U.S. Cl. ..... 40/154; 40/155; 40/158 A; 206/454; 229/31 R; 229/40

[58] Field of Search ..... 40/154, 156, 158 A; 229/23 R, 16 R, 16 D, 31 R, 32, 34 HW, 40, 87 R; 206/453, 454, 586

[56] References Cited

U.S. PATENT DOCUMENTS

| | | | |
|---|---|---|---|
| 1,970,395 | 8/1934 | Schaake | 40/158 A |
| 2,832,466 | 4/1958 | Sheard | 229/23 R |
| 3,586,234 | 6/1971 | Nathan et al. | 229/40 |
| 3,602,367 | 8/1971 | Nathan et al. | 229/40 |
| 3,871,570 | 3/1975 | Garmon | 229/31 R |
| 4,244,128 | 1/1981 | Russell | 40/154 |

FOREIGN PATENT DOCUMENTS

| | | | |
|---|---|---|---|
| 571759 | 5/1932 | Fed. Rep. of Germany | 206/453 |
| 1100688 | 1/1968 | United Kingdom | 229/31 R |

*Primary Examiner*—Gene Mancene
*Assistant Examiner*—James Hakomaki
*Attorney, Agent, or Firm*—Paul M. Denk

[57] ABSTRACT

In a paperboard picture frame or the like support for holding picture or painting frames, or related type of items, a base member comprising a solid sheet of paperboard, or formed as a marginal member, has a series of corner straps depending from it, and which corner straps are sectionalized to provide for the fold over of each strap for embracing the proximate end of the supported frame, with one of the sections of the strap generally folding intermediate of the supported frame and the base member of the support, in order to secure the frame in place without necessitating the usage of any adhesive or other fastener. But, it may be that the final section of the corner strap may be adhesively secured to the underside of the base member to likewise provide for securement of the frame in place. Various modifications to the supported frame include various tabs, that afford protection to the supported frame, various flanges that aid in its handling, or to provide overlying coverage in the event that further protection is needed for the supported frame, particularly when it may be delivered through the mails.

17 Claims, 10 Drawing Figures

FIG. 1.
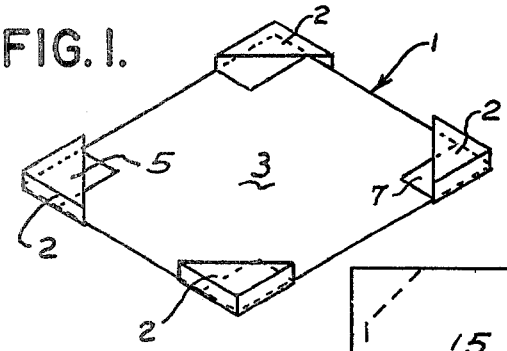
FIG. 8.
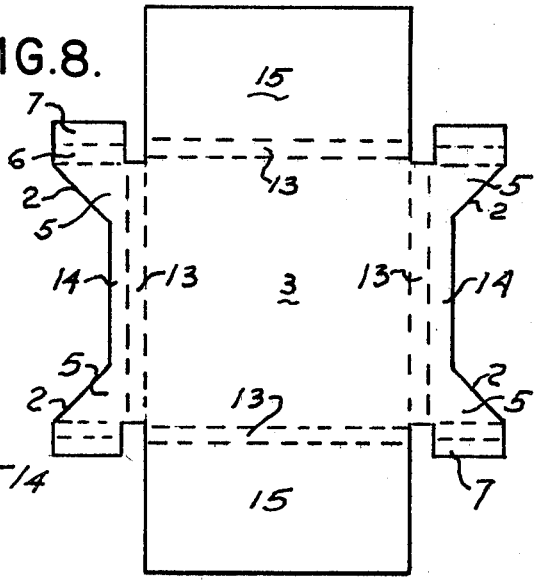
FIG. 9.
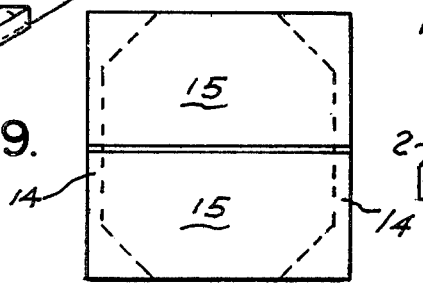
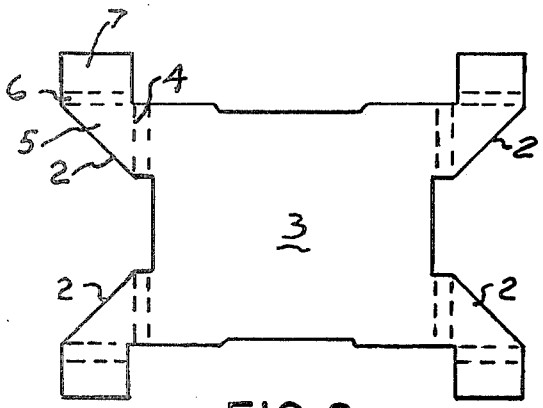
FIG. 2.
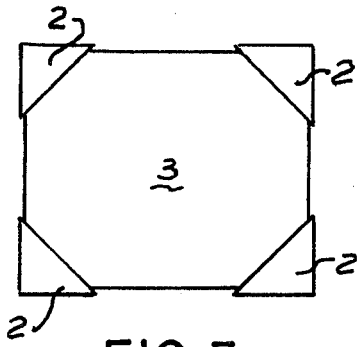
FIG. 3.
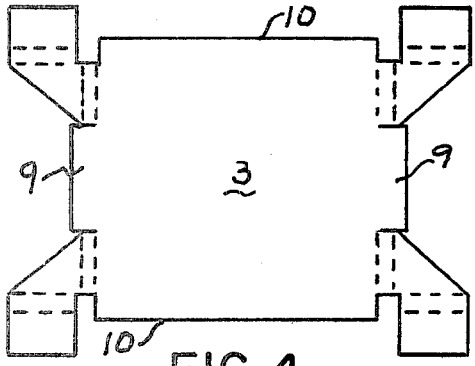
FIG. 4.
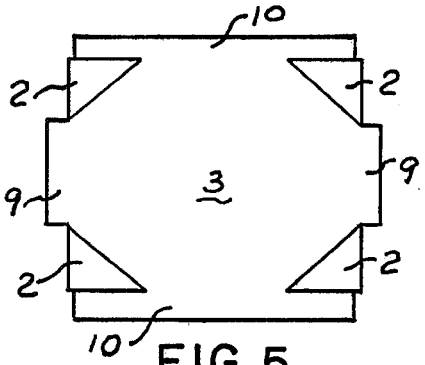
FIG. 5.
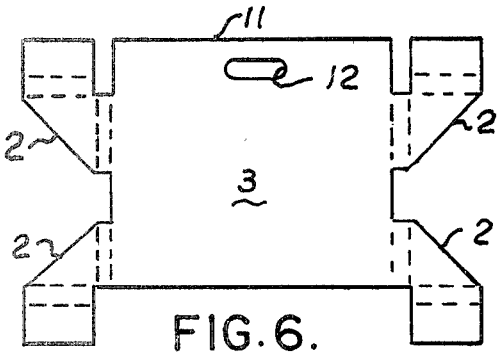
FIG. 6.
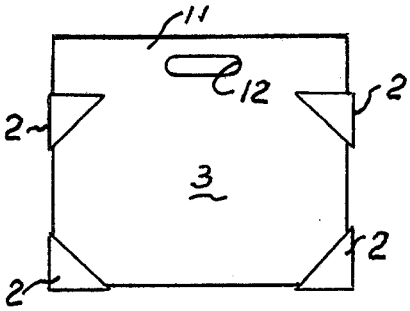
FIG. 7.

PAPERBOARD PICTURE FRAME OR THE LIKE SUPPORT AND DISPLAY

BACKGROUND OF THE INVENTION

This invention relates generally to a display and support for picture frames, or related type items, and more specifically pertains to a formed support cut from a unitary blank of paperboard or other material and which embraces only the corners of the held frame during application.

Numerous cartons and other supporting devices are in the prior art for use in displaying merchandise, pictures, or other wares for sale. But, the formation of a combination display and protective carton utilizing only a base frame support and corner strap means for securement of the frame in place, for both transit purposes, storage purposes, or for display for sale, has not be given adequate consideration in such prior art. In fact, this current invention, as developed, is an improvement over my prior patented paperboard picture display as shown in the U.S. Pat. No. 4,244,128. Where this current invention differs is that it utilizes only singular but integrally formed strap means at one or more corners of the base member for the support, and which can effectively hold the secured picture frame, or the like, in place, while minimizing to the least the amount of materials necessary for achieving a paperboard formed structure for this purpose.

Various other prior art picture holders are available in the art, but are not as pertinent to this current invention as that shown in my prior U.S. patent, as above designated. For example, the U.S. Pat. No. 723,696, to Maine simply discloses a picture holder frame, but one that simply encompasses the frame within a cardboard or other suitable material type of holder for securing the frame therein during shipment. This particular frame is quite distinct and different from what is disclosed as the current invention, and furthermore, a much lesser quantity of paperboard material is required for usage in the formation of the picture frame support of this current invention.

The patent to McLellan, U.S. Pat. No. 1,077,623, discloses a paper or cardboard type of picture frame, but the means for locking the various flaps of this frame together is achieved through the usage of an adhesive that is applied to one of the locking strips of the shown carton. This is distinguished from the current invention, and the picture frame support described herein, in that it does not require any adhesive to hold the corner frame straps around the picture frame supported by this invention, except in that modified embodiment which is listed as an alternative and where an adhesive might be used, if such is desired.

The U.S. Pat. No. 2,851,208, to Samsing discloses a display tray blank and container, as for use for containment of displayed household goods, or other items, during marketing. The only significance of this patented invention of Samsing is that it does display various locking tab elements that can be used for locking the display tray into its folded configuration after it forms various tubular elements around its periphery. Other than this feature, the finished display tray is quite different in both appearance, structure, and method of usage, from that which is defined in this current disclosure.

The U.S. Pat. No. 3,394,862, to Greene, at al, shows a packing container, but principally for use for stacking a variety of articles as packed within such a container, one upon the other. While this particular container does disclose a variety of means for forming marginal panels, from paperboard or corrugated board, and apparently without having to resort to the usage of any adhesive in the process, the specific structure of this particular device requires a multitude of inner, top, and outer side panels, that are all hingedly connected together along marginal fold lines, to form the shown tubular configuration as set forth in this earlier patent. Principally, this concept is, once again, useful for stacking purposes, and is just not fabricated in the manner or structure of the current invention, or for the particular purpose for which this current invention has been designed. Furthermore, much more quantity of paperboard material and stock must be utilized in the construction and formation of this Greene style of prior art packing container.

The U.S. Pat. No. 3,586,234, to Nathan shows a package for tiles, and the like, but this particular package discloses a wraparound style of blank, that is normally quite different in appearance and usage from that corner pad devised and shown in this current invention. The only identity of common structure in Nathan might be the incorporation of what is identified as the central main panel, and having wraparound flanges that are useful for holding a series of flat articles, such as the mirror tiles, as described. This has a similar relationship to the structure of the current invention, as displayed, but only in that modification where various other flaps may be employed in order to form a one pack mailer type of support. The second U.S. Pat. No. 3,602,367, to Nathan upon a mirror package, simply discloses a corrugated paper flat body with cutout portions that can be removed from said flat body and stapled around the perimeter of the product in order to emcompass it and hold a mirror therein for safe shipment.

Various other U.S. patents disclose other types of fabricated cartons, such as that set forth in the Rous U.S. Pat. No. 3,682,370, and useful for totally embracing a book, or the like, for shipment. The U.S. patent to Veenman, shows a carton with a clamping strip, of a rather complex structure in design, and which incorporates a multitude of insert strips, as shown, for use for holding an article in place. It is believed that this particular carton, as shown in this prior art patent, with its variety of clamping strips, is quite distinct from what is shown in this current invention.

Various other U.S. patents disclose other forms of picture frame holders, having relationship to the state of this art, such as shown in the U.S. Pat. No. 2,814,896, to Fujikawa, in the U.S. Pat. No. 1,140,904, to Kiernan, in the prior U.S. Pat. No. 2,772,499, to Ferrucci, in the U.S. Pat. No. 796,310, to Fisher, and entitled Foldable Blank for Forming Picture Frames, and finally in the U.S. Pat. No. 2,021,018, to Page, showing a display device.

It is, therefore, the principle object of this invention to provide a one piece support for a picture frame, or the like, and wherein integrally connected corner straps may be wrapped around one or more corners of the supported frame, and tucked into a securing position, without necessitating the use of any further adhesive or fastening means for providing fully integrated support for the held picture frame.

Another object of this invention is to provide a picture display incorporating various integral strap structures that conveniently position and hold the picture frame centrally upon a base member for near full viewing.

Another object of this invention is the provision of corner strap means in a picture display for use for embracing and holding the frame picture within the confines of the protection furnished by the surrounding base member structure.

Yet another object of this invention is the provision of a picture display that conveniently protects the entire periphery of the framed picture, in particular embodiments, but yet allows almost optimum visual access to the picture supported by the invention, not only at its frontal view, but also along its side edges.

Still another object of this invention is to provide a support for a picture frame, cut from a unitized blank of paperboard or related material, and which utilizes a minimum of paper stock in its formation when compared to prior art type of containers.

Still another object of this invention is to provide a picture frame support incorporating various lateral tabs, or flaps, that not only enhance the protection for the supported frame, but in addition disposes disclosed surfaces upon which printed indicia or other material may be displayed for instructing, advertising, or for stimulating the sale of the embraced product.

Still another object of this invention is to provide a picture frame support that incorporates various foldable panels that afford total enclosure for the supporte,d frame so as to protect it during shipment.

These and other objects will become more apparent to those skilled in the art upon reviewing the summary of this invention, and upon undertaking a study of the description of its preferred embodiment, in view of the drawings.

SUMMARY OF THE INVENTION

This invention comprehends the formation of a paperboard picture frame or the like type of support that is useful for not only holding the frame during shipment or storage, but also has modifications designed into it for supporting the frame during its display for sale, and likewise includes means for facilitating the advertising and marketing of the product. More specifically, the invention is formed from an individual sheet of paperboard material, formed initially as a blank, and because of the unique design of this particular support, incorporating a minimum of structure for holding a frame in place, from a minimum of material is utilized in the construction of the support in its blank form. From the blank, the display can be folded into its usable configuration, surrounding a picture, painting, or other framed item, with the support structure being folded for connection, without the need for any adhesive, or the like, for holding its item for display and marketing. But, even though this type of unique structure for a frame support can be formed from a lessened amount of materials as previously explained, at the same time, it provides an almost full viewing of the aesthetics of any picture or painting that may be supported within the invention.

This support essentially incorporates a back member panel, which mainly comprises a full panel, or perhaps may be structured as a peripheral frame, and which incorporates, approximately at each of its corners, a series of integral corner strap means formed of a series of segments, foldable with respect to each other, so that when each corner strap is folded over into its retention configuration, it overlies the proximate corner of the framed picture, etc., and then may be tucked intermediate the frame and its base member to provide for structural securement of the frame at this location, and without necessitating the use of any adhesive, or other fastening means. But, in the alternative, and perhaps where machinery may be used for folding the support into its frame encompassing configuration, the end segment of each strap perhaps can simply be adhesively connected to the underside of the base member to form the enclosure for securement of the framed picture in place, within the embracing support.

Basically, the corner straps, as previously defined, and which are intergrally structured depending from each corner of the base member, utilize a minimum of material for rigidly securing a framed picture, painting, or the like, in place within a support that may be ready for shipment, display, or for any other usage as desired.

Further embodiments constructed into the support of this invention, particularly in the blank form, includes various extensions, in the form of tabs or flaps, that may project from either the sides, or the upper lower edges, or all of the same, of the back or base member, and therein furnish spacer means that may add protection to the side edges of the framed picture, and in the alternative, or in addition thereto, provide some minimal amount of surface area where advertising, printed instructions, or any other identifying indicia may be applied to further stimulate the sale or aid in the usage of this particular structured support, or its held product. In addition, a flap may extend upwardly with respect to the base member, and have one or more apertures provided therein, to furnish either a hand slot for facilitating the carrying of the supported frame, or perhaps allow its suspension as when displayed for sale upon the market. Furthermore, various flaps and panels may extend from the base member of this invention, and have the corner folding straps extending from particular of these flaps, so that once the corner straps are secured surrounding the framed picture, larger sized panels may be folded over into overlying relationship covering the normally opened front of the framed picture so as to provide it with complete protection, surrounding it from all sides, so as to assure that no damage will be exerted upon the picture frame during its assembly, shipment, display, or when been carried home or elsewhere from the market place by the purchaser.

In the particular construction of the corner strap means of this invention, a first segment extends laterally from preferably the side edges of the said support base member, and these first segments may provide clearance along the height of the framed picture resting upon the base member support, so that when the second segment of each strap is folded over, and triangulated across the corner of the frame, adequate clearance will be provided to allow for such manipulation of the corner strap, either manually, or by folding machinery, as during the packaging of the identified type of frames. In addition, a third segment of each corner strap then folds downwardly along the adjacent side edge of the framed corner, while a fourth segment for each strap then, as previously explained, may be inserted intermediate the positioned frame and the base member of the support, forming an interlocking connection intermediate these two parts, which, when said straps are all folded into the identified configuration, provides for full support for the framed picture for the purposes as previously described.

BRIEF DESCRIPTION OF THE DRAWINGS

In the drawings, FIG. 1 provides an isometric view of the folded picture frame support of this invention;

FIG. 2 provides a plan view of the support shown in FIG. 1, but in the blank form;

FIG. 3 provides a plan view of the folded support blank as shown in FIG. 2;

FIG. 4 provides a plan view of a modified picture frame support in the blank form;

FIG. 5 provides a plan view of the folded support disclosed in FIG. 4;

FIG. 6 discloses a plan view of a modified picture frame support in the blank form;

FIG. 7 provides a plan view of the folded picture frame support shown in FIG. 6;

FIG. 8 provides a plan view of a modified picture frame support in the blank form;

FIG. 9 provides a plan view of the folded picture frame support shown in FIG. 8.

DESCRIPTION OF THE PREFERRED EMBODIMENT

Figure 10:
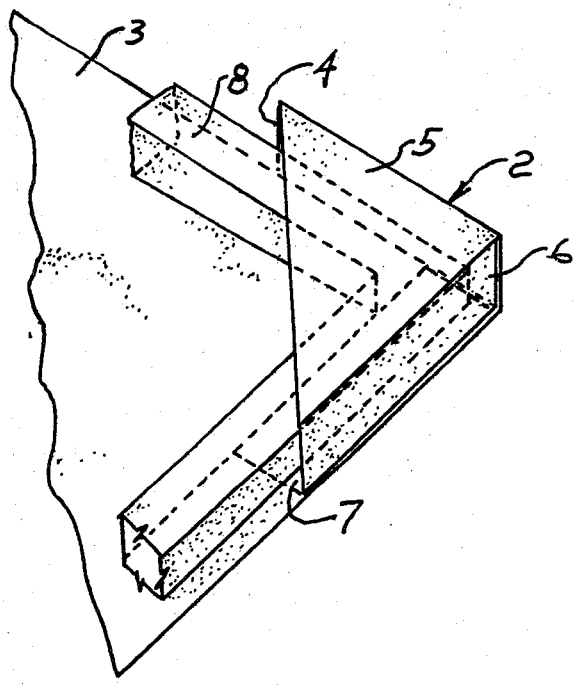
FIG. 10 provides an englarged view of a corner of the folded support shown in FIG. 1, and further disclosing part of a picture frame being embraced and held by the folded corner strap of the support.

In referring to the drawings, and in particular FIG. 1, there is disclosed the paperboard picture frame or the like support 1 useful, as previously alluded to, for supporting a picture frame, painting, or almost any framed item, or for that matter, any item that may have the configuration of the shown support, and which can be embraced by the same for support during shipment, display, or even during storage. At each corner of the support there is provided a corner strap means 2, as shown, and while preferably there will be such a strap means provided at each corner of the support, in actual practice, it may be likely that only a pair of oppositely disposed, or diagonally disposed, corner straps may be required for a particularly configured support. In addition, and as can be further seen, each corner strap means 2 is appended to a base member 3, as shown, and while the base member herein is disclosed being a full formed paperboard structure, of the square or rectangular design, as shown, it is just as likely that the base member 3 may likewise be opened at its central portion, providing a peripheral marginal formed base member that may also allow for the backside of any supported frame to be clearly viewed and inspected by any proposed customer of the same.

As can be seen in the the blank form, for the particular structured support 1 as previously described, and referring to FIG. 2, the base member 3 has the series of depending corner strap means 2, as shown, and with each corner strap means providing a series of sectioned components, having a first section 4 that is foldably connected with an approximate corner of the base member 3, and then incorporates an angulated section 5, that provides for an angled disposition of the corner strap across the corner of the base member 3, and any supported frame, and undertakes the disposition as generally shown in FIG. 1. Then, a third segement 6 foldably connects with the angulated portion 5, generally having a height slightly greater than or equal to the thickness of any frame mounted within the support, while a fourth section 7 foldably connects with the section 6, and generally is useful for being inserted intermediate any supported frame, and the interior surface of the base member 3, to provide for a self-locking of the corner strap about the edge of any supported frame, and without generally necessitating the use of an adhesive, stapling, or other fastening means to secure the same in place. As can generally be seen, the height of the first section 4 is generally to that height necessary to provide for an upward clearance for fold over of the angulated section 5 across the corner of the supported frame, and the height of the section 6 is equivalent to that of the structured section 4, to provide for the properly aligned disposition of the strap section 7 when it is inserted intermediate the supported frame and the base member 3 of the invention.

As can be further seen in FIG. 3, comprising the plan view of the folded support, made from the blank form in FIG. 2, each corner strap means 2 is disposed for embracing just the corners of any supported frame, and therefore, provides for a very clear, and nearly unobstructed view of the frame as held by its support.

A more careful analysis of the exact configuration and foldability of each corner strap means for use for embracing a corner of the supported frame is more accurately disclosed in FIG. 10. As shown, a picture, painting, or other frame 8 is rested upon the base member 3 of the support, and the first section 4 of the said corner strap means folds upwardly, into the disposition as shown, while the angulated second section 5 of the strap means overlies the approximate corner of the identified frame. The third section 6 of the strap means folds downwardly, in order to align the four section 7 for insertion intermediate the arranged frame 8 and the base member 3. When the insertion of this section 7 of the corner strap means is made in the manner as shown, so that the folded corner strap means then becomes an overlying and mild bind upon the proximate corner of the frame 8, the pressure of the section 5 downwardly upon the frame 8 causes a reasonably tight binding of the section 7 intermediate the frame 8 and the base member 3. Thus, the formed corner strap means of the support tightly adheres and holds the frame at this location in place, without necessitating the use of any adhesive, or other fastener, for securing the supported frame in place. On the other hand, it may be that for the convenience of mass assembly and folding of these paperboard supports about the picture frames, it may be desirable to locate the fourth section 7 of the corner strap means beneath the base member 3, and then adhesively secure the same to the underside of said base member for forming the supporting corner of the configured invention.

Various modifications to the invention of this paperboard picture frame support are considered, and as shown in FIG. 4, extensions in the form of tabs 9 may be made from either side edge of the formed base member 3, and likewise, or in the alternative, similar type extensions 10 may be integrated with the upper and lower edges of the said base member 3. Thus, when the framed support is folded into its usable configuration, as can be seen in FIG. 5, these extending tabs provide some clearance externally of the periphery of the support picture frame, and therefore provide some means of protection to these end edges of the held frame, and likewise, provide some additional surface upon which identifying indicia, advertising material, or even printed instructions may be applied to the support, and help stimulate the marketing and usage of the supported product.

As can be seen in FIGS. 6, the base member 3 may have a singular upward extension, in the form of a integral tab, formed as shown at 11, and may even include a hand slot or other aperture 12 therethrough, so that when the support is folded about a frame, as shown in FIG. 7, the arranged slot may add to the convenience of the purchaser of the product, for carrying of the same, or may further facilitate the suspension of the supported frame as at the store for the convenience of its disposition during marketing.

As also shown in FIG. 8, disclosing a modified form of picture frame support, in this particular instance, the base member 3 has a series of intermediate flaps 13 provided around its perimeter and functioning as equivalent strap sections 4, and with the remaining parts of the corner strap means 2 being connected extending from a pair of the flaps, as shown. When the angulated sections of the said corner flaps are folded over, they provide for a slight marginal overlap, as at 14, for securement of the frame in place upon the base member 3 along its entire side edge. In addition, the angulated portions 5 further overly the corners of the supported frame, to assure its retention therein. Furthermore, the remaining sections 6 and 7 of each corner flap then fold into the position as previously explained as shown in FIGS. 1 and 10 of this disclosure. Then, in addition, the flanges 13 integrally connected with the upper and lower edges of the base member 3 have foldably connected to one or both of them, as desired, a panel(s) 15, and which panel(s) then is folded over into overlying relationship upon the previously folded corner straps 2, as previously explained, to provide for full enclosure of the frame therein, to assure that no damage can be exerted upon the frame during its transit, so that the support can further function as a mailer for the frame in the even that its marketing is done by way of the mail order service, or the like.

Variations or modifications to the picture frame support of this invention may occur to those skilled in the art upon reviewing the subject matter of this invention. Such variations, if within the spirit of this invention, are intended to be encompassed within the scope to any claims to patent protection issuing upon this invention. The description of the preferred embodiment set forth herein is done so for illustrative purposes only.

Having thus described the invention, what is claimed and is desired to be secured by letters Patent is:

1. A paperboard picture frame or the like support, comprising a base member means useful for supporting a frame or the like, a series of integral corner strap means integrally connecting proximate select corners of the base member means, each corner strap means being formed of foldably connected sections, each corner strap means formed of foldably connected sections, each corner strap means formed of a series of said extending sections integrally linked together with only a first section integrally foldably connecting with an approximate one side corner edge of the base member means, and with said corner strap means when folded over providing for an embracement of the proximate corner of the positioned picture frame or the like, whereby the final extending section of the corner strap means inserts beneath at least the emplaced frame, and its supporting base member means and with the connected corner strap means thereby securely retaining the contiguous corner of the frame to its support.

2. The invention of claim 1 and wherein each corner strap means having a first section extending upwardly from the base member, a second section extending over a corner of the base member positioned picture frame, a third section extending downwardly along the side edge of the said frame, and a fourth and said final section for securing under the positioned picture frame and retaining the contiguous corner of the said frame to its support.

3. The invention of claim 2 and wherein said corner strap means secure proximate each corner of the base member.

4. The invention of claim 3 and wherein in the blank form, the first section of each corner strap means extends directly from the connected base member, the second section extends approximately angularly from the said first section, and the third section extends approximately at a right angle from the first said section of the corner strap means.

5. The invention of claim 4 and wherein each fourth section of a corner strap means, in the support folded configuration, inserts intermediate the emplaced picture frame and the base member and thereby retains said frame to the folded support.

6. The invention of claim 4 and wherein each fourth section of a corner strap secures to the underside of the base member and thereby retains said frame to the folded support.

7. The invention of claim 6 and wherein said fourth section adhesively secures to the underside of its contiguous base member.

8. The invention of claims 5 or 6 and including said base member having integrally extending portions useful for facilitating the support and protection of the emplaced picture frame.

9. The invention of claim 8 and wherein said base member includes a pair of opposite side edges, and upper and lower edges, and extending tabs formed with each opposite side edge for laterally protecting the supported frame.

10. The invention of claim 8 and wherein said base member includes a pair of opposite side edges, and upper and lower edges, and extending tabs formed with each upper and lower edge for protecting the supported frame at these locations.

11. The invention of claim 8 and wherein said base member includes a pair of opposite side edges, and upper and lower edges, and extending tabs formed with each edge of the said base member for protecting any supported frame.

12. The invention of claim 11 and wherein said extending tabs provide exposed surfaces outside of the emplaced picture frame for reception of printed information of the like thereon.

13. The invention of claim 8 and wherein an extending portion projects upwardly from the base member, said extending portion having at least one aperture therein and useful for suspension of the support held picture frame.

14. The invention of claim 7 and wherein said base member includes a pair of opposite side edges, and upper and lower edges, flaps extending from each base member edge, and when folded angularly with respect to the base member providing protection for the sides of any emplaced frame, and said corner strap means securing with select corners of certain of the extending flaps and useful for securement of the base member supported frame.

15. The invention of claim 14 and including at least one panel connecting with at least one of the base member flaps and useful for overlying the support secured frame and providing it with protection upon its frontal surface.

16. The invention of claim 1 and wherein said corner strap means overlie the four corners of the support held picture frame.

17. The invention of claim 1 and wherein said final section of the corner strap means inserts intermediate the emplaced frame and its supporting base member means.

* * * * *